United States Patent [19]

van Roosmalen

[11] Patent Number: 4,659,964

[45] Date of Patent: Apr. 21, 1987

[54] DISPLAY TUBE

[75] Inventor: Johannes H. T. van Roosmalen, Eindhoven, Netherlands

[73] Assignee: U.S. Philips Corporation, New York, N.Y.

[21] Appl. No.: 677,940

[22] Filed: Dec. 4, 1984

[30] Foreign Application Priority Data

Dec. 27, 1983 [NL] Netherlands ..... 8304444

[51] Int. Cl.[4] ..... H01J 23/16; H01J 29/96

[52] U.S. Cl. ..... 315/3; 313/366; 313/412; 313/413; 313/302

[58] Field of Search ..... 313/302, 304, 309, 366, 313/413, 414, 412; 315/3

[56] References Cited

U.S. PATENT DOCUMENTS

| | | | |
|---|---|---|---|
| 3,755,704 | 8/1973 | Spindt et al. | 313/309 |
| 3,921,022 | 11/1975 | Levine | 313/309 |
| 4,085,376 | 4/1978 | Abramyan et al. | 313/309 |
| 4,124,810 | 11/1978 | Bortfeld et al. | 313/414 |
| 4,178,531 | 12/1979 | Alig | 313/309 |
| 4,513,308 | 4/1985 | Greene et al. | 313/309 |
| 4,528,476 | 7/1985 | Alig | 313/414 |

FOREIGN PATENT DOCUMENTS

| | | | |
|---|---|---|---|
| 2109156 | 5/1983 | United Kingdom | 313/309 |

*Primary Examiner*—Saxfield Chatmon
*Attorney, Agent, or Firm*—Robert J. Kraus

[57] ABSTRACT

A display tube comprising in an evacuated envelope (1) an electron gun system (6) for generating and focusing by means of a focusing lens at least two electron beams (28 to 35) on a display screen (5), which electron beams are deflected by deflection means and describe a frame on the display screen. The electron gun system (6) comprises at least two electron sources (20 to 26), the electrons in each electron beam being accelerated immediately after leaving the electron source by means of an electric field having a field strength exceeding 600 V/mm. The central axes (36) of the electron beam extend substantially parallel to each other, and all beams are converged by the focusing lens in the immediate proximity of the focus of the focusing lens, after which each separate beam is focused on the display screen by the focusing lens to form a spot. The astigmatism and the coma of the focusing lens, especially for objects not situated on the tube axis, decreases rapidly with decreasing object potential with the beam aperture angle being kept the same. The electrons leave the source at a low potential and are then accelerated in a strong electric field exceeding 600 V/mm nearly immediately after leaving the electron source, thereby effecting production of a very narrow electron beam which remains narrow up to the display screen. The effect of the field curvature of the focusing lens is also considerably reduced by the narrow beams. If all electron beams through the focusing lens converge in the immediate proximity of the focus of the focusing lens, a minimum of aberrations as a result of the deflection is obtained. The electron sources are preferably P-N cathodes or diode type electron guns.

6 Claims, 5 Drawing Figures

DISPLAY TUBE

BACKGROUND OF THE INVENTION

The invention relates to a display tube comprising, in an evacuated envelope, an electron gun system for generating and focusing on a display screen (by means of a focusing lens) at least two electron beams. The electron beams are deflected by deflection means and describe a frame on the display screen.

Such a display tube is known from U.S. Pat. No. 4,301,389 in which a matrix of individually controllable electron sources is used which generate a number of electron beams. Such a multi-beam display tube may be used as a projection television display tube because a larger beam current can be combined with a larger resolving power as compared with a monobeam display tube. It may also be used, however, as a D.G.D. tube (D.G.D=Data Graphic Display) or as a tube having a large display velocity for displaying computer data. Lens defects of the focusing lens, for example, spherical aberration, astigmatism, coma and field curvature enlarge the spot of an electron beam on the display screen of the tube. When using a number of electron sources in one row or in one plane it is very difficult to obtain a number of identical spots on the display screen, because the influence of the lens defects increases as the distance to the axis of the focusing lens increases.

SUMMARY OF THE INVENTION

It is therefore an object of the invention to provide a display tube in which it is possible to obtain a number of substantially identical spots on the display screen.

According to the invention, a display tube of a type mentioned in the opening paragraph is characterized in that the electron gun system comprises at least two electron sources the electrons of which in each electron beam are accelerated immediately after the electron source by means of an electric field having a field strength exceeding 600 V/mm, the central paths of the electron beams extending substantially parallel to each other, all beams being converged by the focusing lens in or in the immediate proximity of the focus of the focusing lens, after which each separate beam is focused on the display screen by the focusing lens to form a spot also in the case of deflection of the beams by the deflection means.

The astigmatism and the coma of the focusing lens, especially for objects not situated on the axis, decrease rapidly with decreasing object potential with the beam angular aperture kept the same. The electrons leaving the source at a low potential are then accelerated in a strong electric field exceeding 600 V/mm. In this manner, almost immediately after the electrons have left the electron source, a very narrow electron beam is obtained which remains narrow up to the display screen. The depth of focus of such beams is therefore very large. Because of the narrow beams the effect of the field curvature of the focusing lens is also reduced considerably. If all the electron beams through the focusing lens coincide in or in the immediate proximity of the focus of the focusing lens, a minimum of aberrations as a result of the deflection is obtained. Possibly the focus of the focusing lens is situated in the proximity of the deflection point of the deflection means. Because the total system operates with very narrow beams, the convergence errors become very small during deflection of said beams.

A first preferred embodiment of the invention is characterized in that the electron sources are P-N cathodes. P-N cathodes are disclosed in Netherlands Patent Application No. 7905470, corresponding to U.S. Pat. No. 4,303,930, which may be considered to be incorporated herein by reference. Such a P-N cathode comprises a semiconductor body having a P-N junction between an N-type region adjoining a surface of the semiconductor body and a P-type region. By applying a voltage in a first direction across the P-N junction in the semiconductor body, electrons are generated by avalanche multiplication and emanate from the semiconductor body.

P-N cathodes can very readily be used with a potential in the object plane near 0 volt. P-N cathodes have a number of additional advantages. High cathode loads can be realized. Each electron beam having a P-N cathode can easily be controlled. The high field strength immediately in front of the cathodes is no problem. Because the P-N cathodes can be manufactured by means of the usual semiconductor technology, it is possible to provide the electron sources at arbitrary positions so that any desired mutual distance can be realized. This is of importance for the correction of the picture distortion of the focusing lens. The variation of the mutual distance between the electron sources can as a matter of fact be chosen to be so that the distances between the spots on the display screen are equal and are, for example, equal to double the line distance between two picture lines.

A second preferred embodiment of the invention is characterized in that the electron sources are diode type electron guns. Diode type electron guns are disclosed in U.S. Pat. No. 3,831,058 which may be considered to be incorporated herein and Netherlands Patent Application No. 8302754, corresponding to U.S. patent application Ser. No. 635,774, filed July 30, 1984, which may be also considered to be incorporated by reference. In such diode type electron guns, electron acceleration takes place between a thermal cathode and an apertured grid which has a positive potential with respect to the cathode.

The use of the above-mentioned types of electron sources becomes possible by the low object potential, while the overall enlargement also decreases.

It is also possible to make the plane in which the electron sources are present curved so as to produce corrections of the pattern of spots on the display screen.

It will be obvious that, if the electron sources are situated on one line, the electrodes of the focusing lens system need not have a rotational symmetry, but may be replaced by a set of plates between which focusing cylinder lenses are formed in one direction, the direction of the line.

BRIEF DESCRIPTION OF THE DRAWING

The invention will now be described in greater detail, by way of example, with reference to the accompanying drawing, in which.

DESCRIPTION OF THE PREFERRED EMBODIMENT

Figure 1:
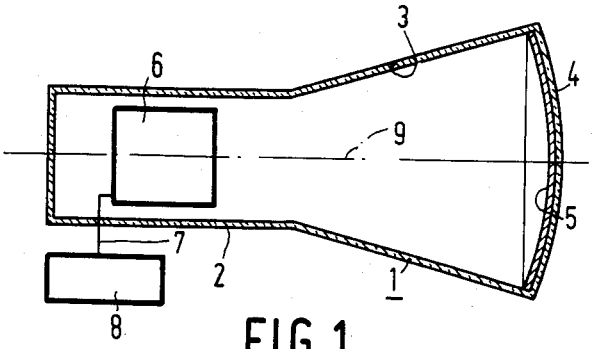
FIG. 1 is a diagrammatic sectional view of a display tube according to the invention.

FIG. 1 is a diagrammatic sectional view of a display tube according to the invention. It comprises a glass envelope 1 consisting of a neck 2, a funnel-like part 3, and a display window 4. A display screen 5 comprising luminescent material is provided on the inside of the display screen. Provided in the neck 2 of the tube is an electron gun system 6 for generating at least two electron beams and focusing the beams on the display screen 5 by means of a focusing lens (not shown). The electron gun system 6 is connected via a connection 7 to a source of control signals 8 with which each electron source is controlled. The electron gun system is centred around the tube axis 9. The electron beams are deflected over the display screen by deflection means not shown.

Figure 2:
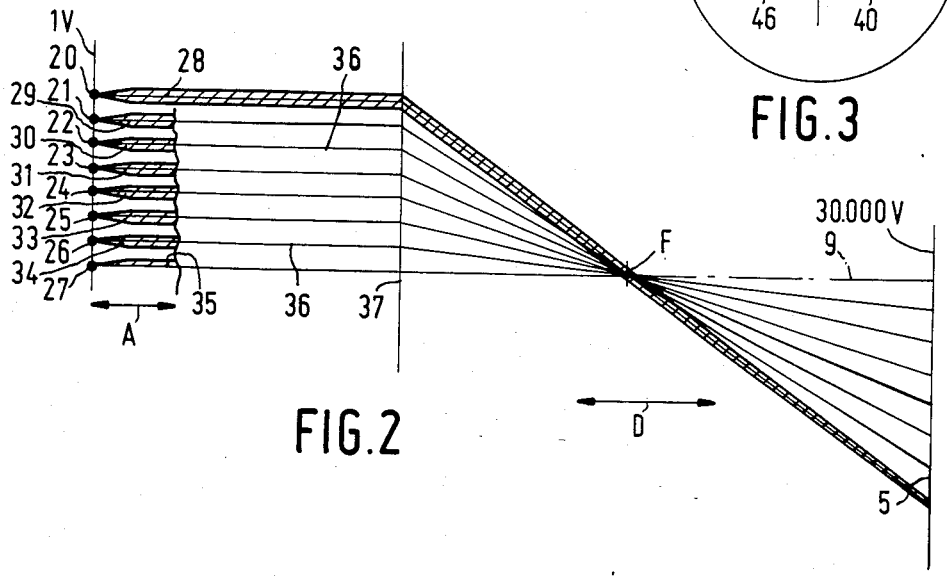
FIG. 2 shows diagrammatically the operation of a display tube according to the invention.

FIG. 2 shows diagrammatically the operation of a display tube according to the invention. The electron sources in this case consist of a row of P-N cathodes of which only the cathodes 20 to 27 on one side of the tube axis 9 are shown. In these cathodes the initial velocity of the electrons of the electron beams 28 to 35 corresponds to a potential of 1 volt. The strongly accelerating electric field in the area A for the electron sources compels the electron beams to extend parallel to the axis of the focusing lens. Only beam 28 is fully shown (shaded). Only the central paths 36 of the electron beams 29 to 35 are shown. The focusing lens shown diagrammatically by a line 37 and having focus F converges the electron beams at the focus and focuses each beam on the display screen 5, which is also indicated by a line. Because the electron beams in the deflection field are very narrow, the deflection errors caused by the deflection field in the electron beams are very small. The deflection may be carried out electrostatically, for example, by means of a set of deflection plates, or magnetically by means of deflection coils. The deflection point is found by determining the point of intersection of the tangent of a completely deflected electron beam with the axis 9. The focusing lens may be an electrostatic electrons lens composed of two or more electrodes. However, it is also possible to use a magnetic focusing lens. Instead of a row of electron sources, a matrix of electron sources may, of course, also be used.

Figure 3:
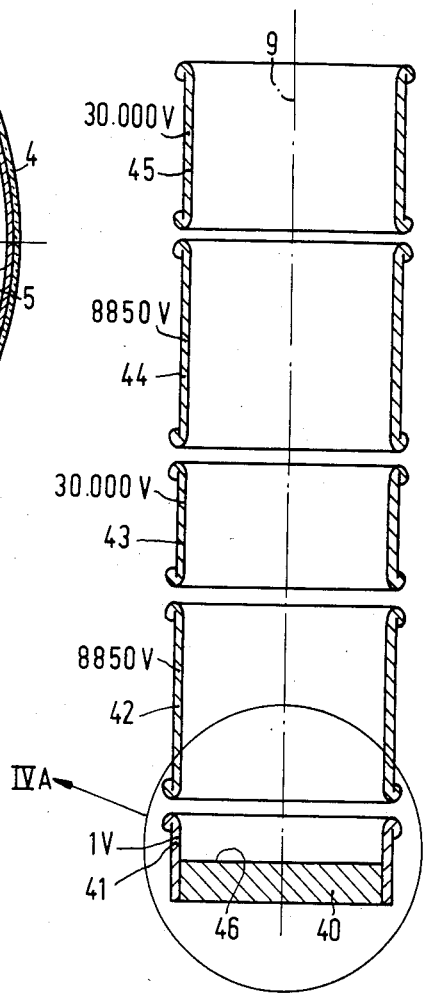
FIG. 3 is a sectional view of an electron gun system for a display tube according to the invention.
Figure 4A:
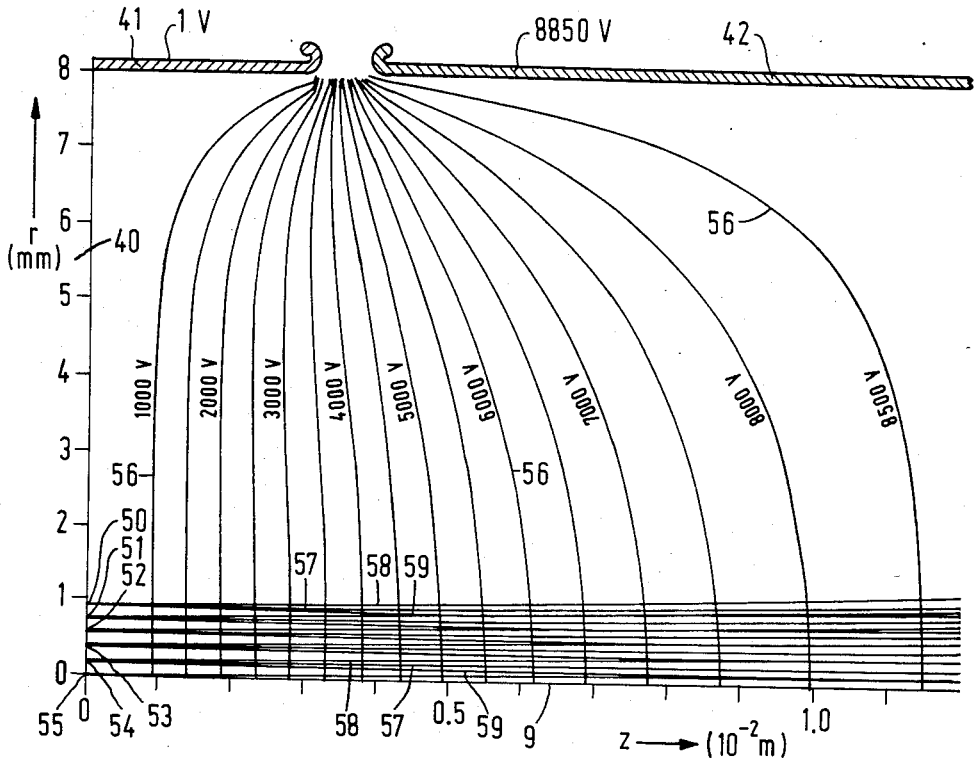
FIG. 4*a* shows a detail of FIG. 3.

FIG. 3 is a longitudinal sectional view of an electron gun system for a display tube according to the invention. Cathode unit 40 comprises a row of electron sources which are shown partly in FIG. 4*a* and comprises a cylindrical collar 41. Because the cathode unit 40 and collar 41 have a potential of 1 volt and the next electrode 42 along axis 9 has a potential of 8850 volts, a strongly accelerating electric field of 1100 volts/mm arises in the special configuration immediately in front of the electron sources. By giving the potentials on the cylindrical electrodes 43, 44 and 45 a value as is shown in FIG. 4*a*, a combination is obtained of an accelerating lens and a unipotential focusing lens. It will be obvious that other types of focusing lenses having more or fewer electrodes may also be used. Up till now the distance to the object (in most tubes the cross-over in the triode part of the electron gun) was chosen to be sufficiently large to prevent an undesired influence of the field of the focusing lens system on the object. In contrast herewith, the object plane 46 with the electron sources is placed in this case very closely to the focusing lens. The strongly accelerating field for the electron sources operates as a so-called "proximity focus" and compels both the electrons and the electron beams to extend parallel to their respective beam axes and to axis 9.

FIG. 4*a* shows a detail of FIG. 3. Cathode unit 40, collar 41 and a part of electrode 42 are shown on one side of the axis 9. The cathode unit comprises 11 electron sources, in this case PN-cathodes, of which the electron sources 50 to 55 are shown here on one side of the axis 9. The distance between the electron sources and the axis 9 are recorded in the table below.

| No. Electron source | Distance r (μm) |
|---|---|
| 50 | 918 |
| 51 | 760 |
| 52 | 587 |
| 53 | 401 |
| 54 | 204 |
| 55 | 0 |

A number of lines of intersection 56 of the equipotential planes with the plane of the drawing are shown between the cathode unit 40 with collar 41 and eletrode 42. With these lines of intersection the potentials are indicated along axis 9 (the z-direction) and the scale divisions are provided in the r-direction. The electron beams generated by the electron sources 50 to 54 are each indicated by their central axis 57 and by their outer boundaries 58 and 59, which are defined by electrons which have left the electron source at angles of +30° and −30°, respectively, with the central beam axis.

Figure 4B:
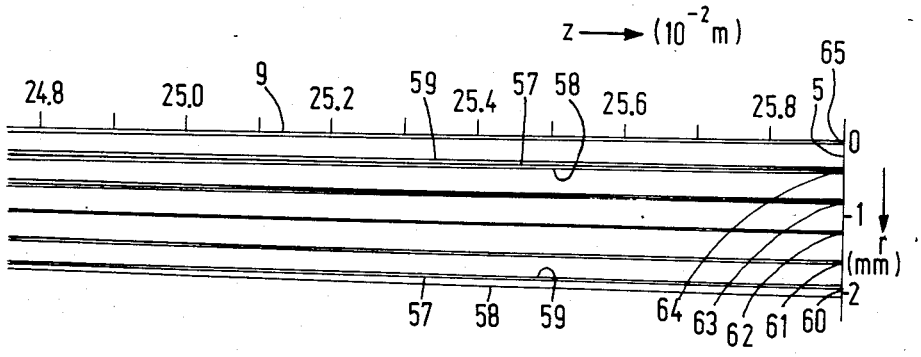
FIG. 4*b* shows the electron paths near the display screen.

FIG. 4*b* shows the electron beams shown in FIG. 4*a* immediately in front of the display screen 5 after they have passed the lens shown in FIG. 3.

The electron beams generated by means of the electron sources 50 to 55 form the spots 60 to 65 on the display screen 5. The distances between the spots 60 to 65 and the axis 9 are recorded in the table below.

| No. spot | Distance r (μm) |
|---|---|
| 60 | 2000 |
| 61 | 1600 |
| 62 | 1200 |
| 63 | 800 |
| 64 | 400 |
| 65 | 0 |

From this table it appears that it is possible, by suitably choosing the distances between the electron sources, to make the distances between the spots equal, for example, 400 or 200 μm.

What is claimed is:

1. A display tube comprising an evacuated envelope containing a display screen, an electron gun system for producing a plurality of electron beams directed toward the display screen and for focusing said electron beams at said display screen, and deflection means for producing a deflection field to effect deflection of the electron beams across the display screen;

characterized in that the electron gun system comprises, disposed along an axis thereof:

(a) a plurality of electron sources arranged transversely of the axis for individually emitting electrons;

(b) a first electrode means for producing immediately adjacent the electron sources an accelerating field having a strength exceeding 600 V/mm, said accelerating field effecting acceleration of the electrons emitted from said electron sources into respective closely-spaced electron beams which are narrow with respect to a cross-sectional area collectively defined thereby and which have respective central axes that are parallel to each other; and (c) a second electrode means for producing an electron lens having a cross-sectional area which is relatively large with respect to said area collectively defined by the electron beams and being located such that said electron beams pass through a central region thereof, said electron lens effecting convergence of the electron beams substantially at a focus thereof disposed in the deflection field, and effecting said focusing of said electron beams at said display screen.

2. A display tube as in claim 1 characterized in that the electron sources are P-N cathodes.

3. A display tube as in claim 1 characterized in that the electron sources are diode-type electron guns.

4. A display tube as in claim 2 or 3 characterized in that adjacent ones of the electron sources are spaced apart by distances which effect uniform spacing between spots produced on the display screen by the electron beams originating at said electron sources.

5. A display tube as in claim 1, 2 or 3 characterized in that the electron sources define a curved surface of a semiconductor in which they are provided.

6. A display tube as in claim 1, 2 or 3 characterized in that the display tube comprises a projection television display tube.

* * * * *